US005666101A

United States Patent [19]

Cazzani et al.

[11] Patent Number: 5,666,101

[45] Date of Patent: Sep. 9, 1997

[54] HIGH-EFFICIENCY APPARATUS FOR MEASURING OPERATIONAL PARAMETERS AND TIMES OF VEHICLES RUNNING AROUND A RACETRACK

[76] Inventors: Umberto Cazzani, Via G. Rossini, 41, I-20040 Monticello Brianza; Massimo Pagetti, Via S. Fedele 8713, 27020 - Sommo (Pavia), both of Italy

[21] Appl. No.: 562,243

[22] Filed: Nov. 22, 1995

Related U.S. Application Data

[63] Continuation of Ser. No. 50,491, filed as PCT/EP91/02419, Dec. 16, 1991, published as WO92/10811, Jun. 25, 1992, abandoned.

[30] Foreign Application Priority Data

| | | | |
|---|---|---|---|
| Dec. 14, 1990 | [IT] | Italy | 22388/90 |
| Dec. 14, 1990 | [IT] | Italy | 22389/90 |
| Dec. 14, 1990 | [IT] | Italy | 22390/90 |

[51] Int. Cl.[6] ..... G08B 23/00

[52] U.S. Cl. ..... 340/323 R; 340/988; 364/410; 455/517

[58] Field of Search ..... 340/323 R, 933, 340/992, 941, 539, 988; 180/168; 364/410; 455/54.1; 273/86 R; 472/86, 85

[56] References Cited

U.S. PATENT DOCUMENTS

| | | | |
|---|---|---|---|
| 3,546,696 | 12/1970 | Waters et al. . | |
| 3,714,649 | 1/1973 | Brouwer et al. . | |
| 3,795,907 | 3/1974 | Edwards | 340/323 R |
| 3,946,312 | 3/1976 | Oswald et al. | 273/86 R |
| 4,142,680 | 3/1979 | Oswald et al. . | |
| 4,449,114 | 5/1984 | Fascenda et al. | 340/988 |
| 4,857,886 | 8/1989 | Crews | 340/988 |
| 4,926,494 | 5/1990 | Potter | 340/941 |
| 5,140,307 | 8/1992 | Rebetez et al. | 340/988 |
| 5,194,843 | 3/1993 | Jones et al. | 340/539 |
| 5,241,487 | 8/1993 | Bianco | 340/323 R |

FOREIGN PATENT DOCUMENTS

| | | |
|---|---|---|
| 0178924 | 4/1986 | European Pat. Off. . |
| 2619644 | 2/1989 | France . |

*Primary Examiner*—Brent A. Swarthout
*Attorney, Agent, or Firm*—Ronald C. Hudgens; Arthur W. Fisher

[57] ABSTRACT

A high-efficiency apparatus for real time measuring of parameters and operational times of vehicles running around a racetrack. At least one detecting station is arranged at a location along the racetrack and is set up to both receive and transmit radio frequency (RF) signals both from/to a transceiver unit installed on each vehicle, the transmitting from the transceiver unit being in response to the transmitting from the detecting station, the station being provided with an electronic radio frequency-converter for transmitting and modulating the received signals over a wide band coaxial cable.

15 Claims, 4 Drawing Sheets

HIGH-EFFICIENCY APPARATUS FOR MEASURING OPERATIONAL PARAMETERS AND TIMES OF VEHICLES RUNNING AROUND A RACETRACK

This application is a continuation of application Ser. No. 08/050,491, filed as PCT/EP91/02419, Dec. 16, 1991, published as WO92/10811, Jun. 25, 1992, and now abandoned.

FIELD OF THE INVENTION

This invention relates to a high-efficiency apparatus for measuring operational parameters and times of vehicles running around a racetrack.

BACKGROUND

In the specific applicative field of this invention a well-recognized requirement is that information on the partial and overall travel times of a running vehicle should be provided in real time.

The difficulties encountered in filling this demand are intensified where several vehicles competent in a race are running around the same one track. In fact, it is not so easy to identify each of the vehicles and record all the run times around the track.

While some solutions have been proposed in the prior art to meet the above-mentioned requirement, these have shown to be less than fully satisfactory.

For instance, apparatus and recording systems have been known which are based on the use of photocells being linked to PC's through a so-called telephone loop to record the pass of each vehicle.

Other approaches make use of an RF transmitter installed on each vehicle in a race and a single receiver antenna buried beneath the track finish line.

While serving their purpose to some extent, the above prior solutions have presently become obsolete because they can only operate with a limited number of vehicles running at one time. In neither instances, moreover, can such conventional solutions provide for the transmission of engine, electrical or aerodynamic parameters of the running vehicles.

In addition, the apparatus employed in conventional measuring apparatus have operating rates which are liable to much interference from the traffic volume of data being transmitted, thereby they require intense maintenance by skilled personnel.

It should be further added that such prior apparatus are no permanent intallations, but are installed temporarily on a racetrack according to necessity, which entails considerable adjustment work by skilled personnel, lasting several hours, before each race.

The underlying technical problem of this invention is to provide an apparatus for measuring operational parameters and times of vehicles running around a racetrack in real time, which has such structural and functional features as to enable prompt identification of any of the vehicles in the race while providing measurements of partial and overall speed and travel times over the racetrack for each of the vehicles.

Another object of the invention is to enable transmission and computer processing of the measurement information from each vehicle.

This technical problem is solved by an apparatus as indicated, being characterized as in the appended claims.

The features and advantages of an apparatus according to the invention will become apparent from the following detailed description of an embodiment thereof, given by way of illustration and not of limitation with reference to the accompanying drawings.

SUMMARY OF THE INVENTION

A high-efficiency apparatus for real time measuring of parameters and operational times of vehicles running around a racetrack is provided. At least one detecting station is arranged at a location along the racetrack and is set up to both receive and transmit radio frequency signals both from/to a transceiver unit installed on each vehicle. The transmitting from the transceiver unit is in response to the transmitting from the detecting station. The station is provided with an electronic radio frequency-converter for transmitting and modulating the received signals over a wide band coaxial cable.

In an embodiment of the invention, a plurality of detecting stations are arranged at selected locations along the racetrack. A transceiver unit is mounted on each vehicle and is operative to both receive and transmit information from/to each station. A loop connection structure interconnects the stations with a central processing unit.

DETAILED DESCRIPTION

Figure 1:
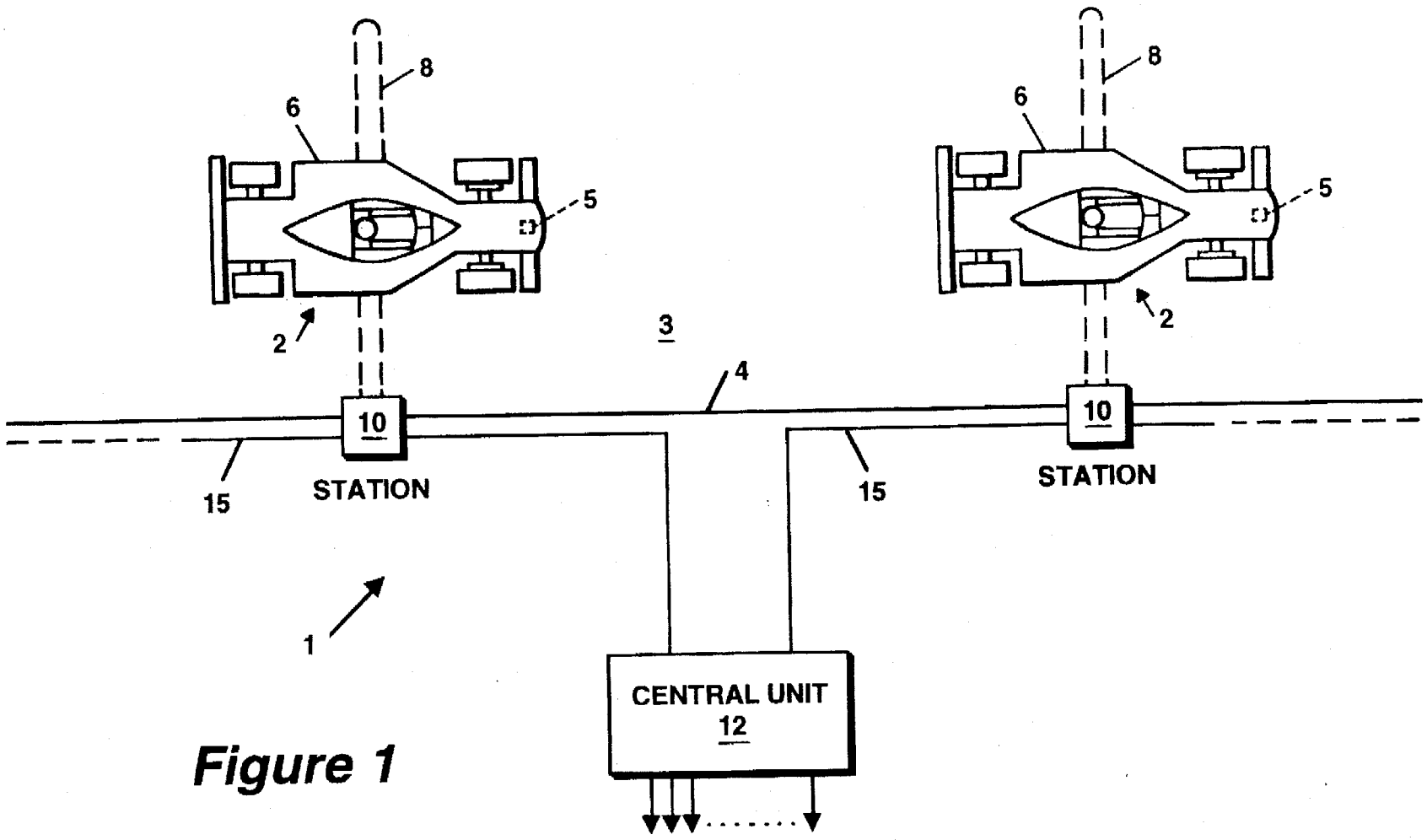
FIG. 1 is a diagramatic representation of an apparatus according to the invention.

With reference to the drawing figures, generally and schematically shown at 1 is an apparatus embodying this invention and being adapted to measure, in real time, operational parameters and times of vehicles 2, such as racing cars running around a race track.

Track means here any generic racetrack, path, or closed-loop course, such as a motordrome, along which vehicles of varying description may have to face speed and/or endurance trials and compete with one another in a race.

The apparatus 1 comprises a set of operational units which are structurally independent of but interact with one another.

Provided along the track may be plural detecting stations 10 installed at selected locations on one side of the track. A preferred embodiment of the installation provides no less than thirty two stations 10 along the course which may be placed behind the conventional bumping barrier.

Shown in FIG. 1 is a section 3 of a track, on one side whereof there are arranged two identical detecting stations whose constructions will be described in detail hereinafter.

Each vehicle 2 mounts a transceiver unit 5 operative to receive and transmit RF information from/to each station 10.

In a preferred embodiment, the unit 5 is secured under the bodyframe 6 of the vehicle 2.

Each detecting station 10 includes an antenna 8 lying transversely to the track. Specifically, the antennae 8 would be buried beneath the track surface such that the vehicles 2 will cross the antennae along their travel path from an overlying position, as shown schematically in FIG. 1.

Also provided is an interconnection looped or segmented structure 15 wherethrough all of the stations 10 are connected to a central processing unit 12 operative to supply, for each vehicle 2, full information pertaining to partial and overall travel times around the racetrack.

The structure 15 is advantageously comprised of a wide band coaxial cable interconnecting the various stations 10 and the central unit 12.

The method of operation of the inventive apparatus will be now described briefly: further on, this method will be discussed in greater detail.

Upon one of the vehicles 2 in the race according to its travel path crossing or moving past one of the antennae 8, the transceiver unit 5 will pick up a signal from station 10. Preferably, this signal would be emitted at a frequency of 153.6 kHz or 143.6 kHz.

On receiving this signal, the transceiver unit 5 will be driven, in turn, to emit an RF signal, which signal is emitted at a single selected frequency of vehicle identification in the 1.2 GHz band.

The station 10 picks up the return signal on the same antenna 8.

Through a frequency conversion, the detecting station transmits the received signals to the central unit 12. The transmission takes place over the wide band coaxial cable 15 interconnecting all of the detecting stations 10.

The information received by the central unit 12 is processed to obtain the parameter of the time when a vehicle 2 has moved past a given station 10.

Figure 2:
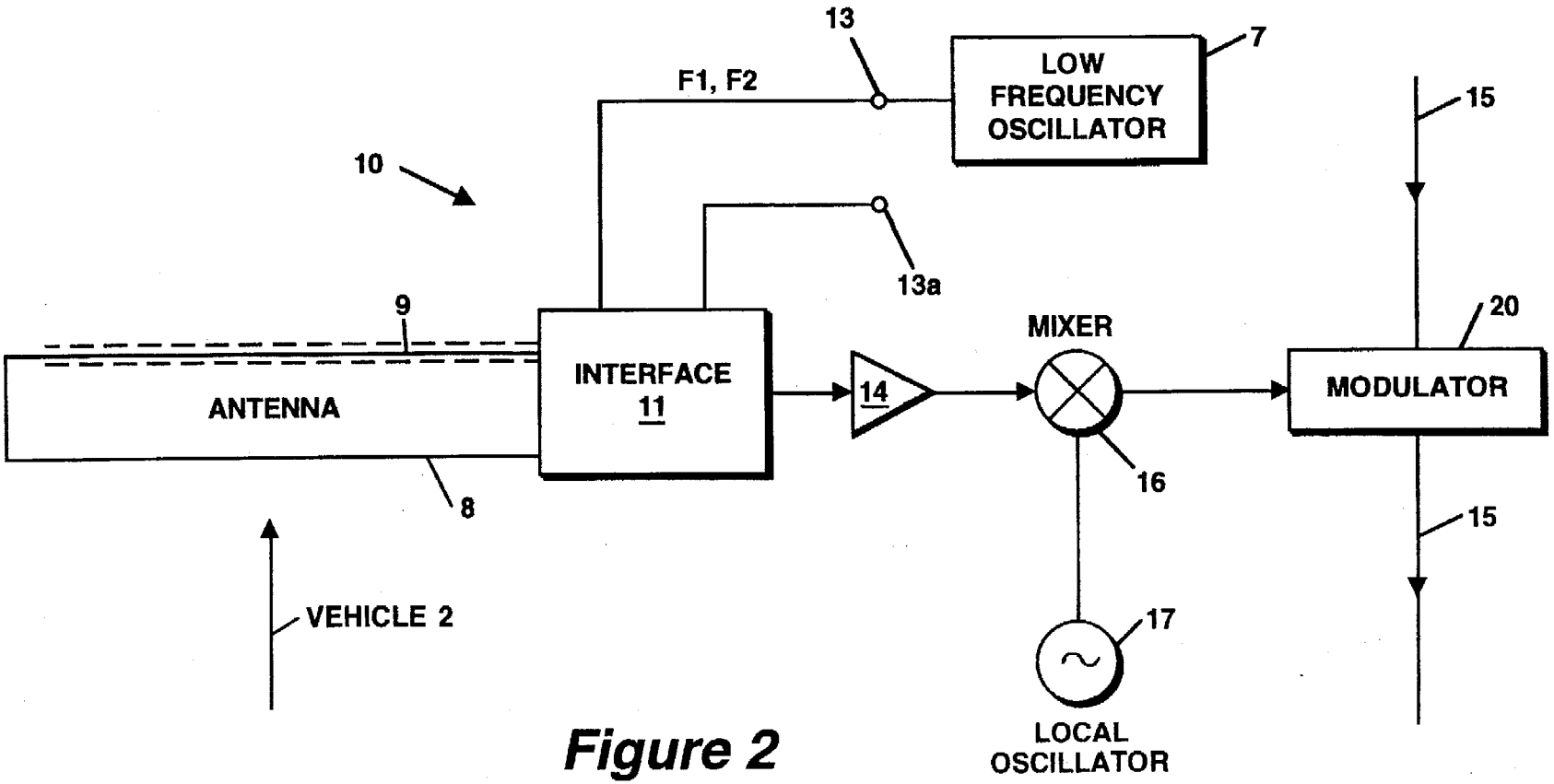
FIG. 2 is another diagramatic view, showing a detail of the apparatus in FIG. 1.

Now, the structure of each detecting station 10 will be described with reference in particular to the example of FIG. 2.

As mentioned above, each station 10 includes an antenna 8 comprising a section of a cable conductor 9, essentially bent into a U-shape and having opposite ends which are run to an interface 11. The cable 9 is buried under the track surface transversely to the running direction thereof, and the interface 11 is housed and powered within a sealed case connected to the remaining circuitry of station 10 through a multipolar connector.

The interface 11 incorporates electronic circuitry, not shown because conventional, for driving the RF emission from the antenna 8 under control by control signals F1, F2 which are received on an input terminal 13. Another input terminal 13*a* is arranged to receive test signals of the antenna operability.

The signals F1 and F2 come from a low-frequency oscillator, such as a so-called crystal, installed at the station 10 and being controlled and powered over a six-way bus line.

The antenna 8 is, therefore, set up for emitting the signals F1, F2 at two pre-determined frequencies: 153.6 kHz±100 Hz and 143.6 kHz±100 Hz.

The antenna 8 also receives signals in the 1.2 GHz band. For picking up such signals, a high-frequency amplifier 14 is connected downstream from the interface 11.

The station 10 further includes a mixer 16 having a first input connected to the amplifier 14 output and a second input receiving a signal generated by a local oscillator 17 which operates at 1.1435 GHz. The mixer 16 is adapted to convert the signal received in the 1.2 GHz frequency band to a useful signal for transmission over the coaxial cable 15.

Accordingly, the difference between the values of the signals at the respective inputs of the mixer 16 will be addressed to the input of a modulator 20 connected in the coaxial cable 15 to enable the transmission of information to the central unit 12.

The modulator allows, therefore, of the output signal from the mixer 16 to be modulated such that each of the different stations 10 can be identified by the central unit 12 during a data transmission. In fact, the one difference between the various stations 10 is given by the modulation of the signal that arrives at the central unit from each of them over the wide band cable 15.

The working frequency of the cable 15 is within the range of 71.750 MHz to 137.075 MHz. Consequently, the carrier frequency identifying each of the vehicles 2, being emitted by the corresponding transceiver unit 5, will be converted through the mixer 16 to enable its transmission over the cable 15. The frequency of the output signal will depend, therefore, on which vehicle is moving above the antenna 8.

For instance, if a carrier frequency of 1.215 GHz is associated with a vehicle, the corresponding carrier on the wide band cable would be 71.75 MHz. Likewise, to a second vehicle having an identifying frequency of 1.2155 GHz, there would correspond a frequency of 72.25 MHz downstream from the mixer 16.

In any case, the frequency modulation wherewith these signals are transmitted over the cable 15 will enable the central unit 12 to also identify the emitting station 10.

The output impedance to the coaxial cable of the modulator 20 is selected to be 75 R, thereby when the unit 5 on the vehicle is 500 millimeters above the antenna 8, the signal received by the central unit will be a level of −20 dBm or lower.

Any other services for which the cable 15 may be utilized would not interfere with the band used for the above-mentioned measurement.

It should be mentioned for completeness that the station 10 is installed inside a sealed case affording a protection rating of IP65, and is suitable for operation within a temperature range of −25° C. to +50° C. The electronic circuitry is supplied a voltage in the 37 to 65 Volts range at 50 Hz from the coaxial cable itself.

Figure 3:
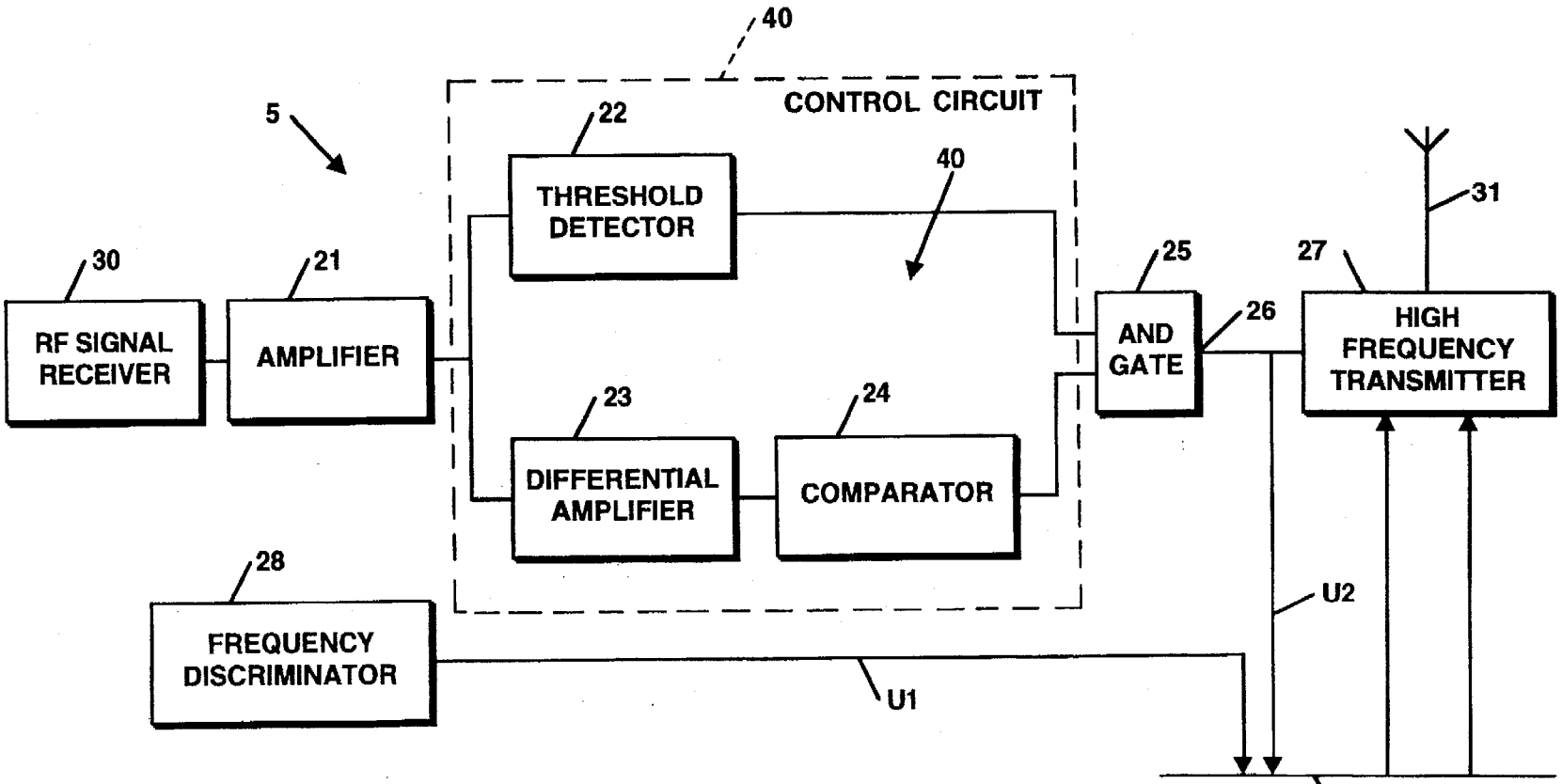
FIG. 3 is a diagramatic view showing a further detail of the apparatus in FIG. 1.

While co-operating directly with the detecting station 10, the transceiver unit 5 is illustrated in detail by FIG. 3.

It is powered, in a manner known per se, from resident batteries, but alternative powering from the vehicle standard battery is also contemplated.

Said unit 5 comprises an RF signal receiver 30 having a first winding tuned to the frequency of 153.6 kHz and a second winding tuned to 143.6 kHz.

Connected downstream from the receiver 30 is a meter-amplifier 21 which has an output connected to a control circuit portion 40.

Provided on the one side in the portion 40 is a threshold detector 22 having an input connected to the amplifier 21 output. On the other side, the amplifier 21 output is connected to the input of a differential amplifier 23 with an associated comparator 24.

The respective outputs of the threshold detector 22 and the comparator 24 are connected to corresponding inputs of a logic gate 25 of the AND type which drives, through an output 26 thereof, a high-frequency transmitter 27 operative to emit signals in the 1.2 GHz band through an antenna 31.

Specifically, the frequency band allocated to this transmission is in the range of 1.215 GHz to 1.280325 GHz; in this way, a selected identification frequency can be associated with each vehicle.

As an example, there may be associated with a first vehicle a frequency of 1.15 GHz, and with a second vehicle, another frequency of 1.2155 GHz, 625 kHz apart from the former.

Accordingly, by selecting frequencies which lie 500 kHz or 625 kHz apart, it becomes possible to identify, within the above-specified band, up to over one hundred vehicles competing on the same racetrack.

The unit 5 is also provided with a frequency discriminator 28 which is connected to the receiver 30 output and operative to generate a signal U1 indicative of the vehicle having moved past, over an antenna 8. A second signal U2 from the output of the AND gate 25 indicates with antenna 8 has been run over.

These signals U1, U2 are addressed to a serial connector 29 which is connected to a pair of inputs of the transmitter 27 to supply information and a timing pulse where the unit 5 is used for telemetric transmissions at 256 kbaud.

Upon the receiver 30 picking up the signal at 153.6 kHz or 143.6 kHz from the antenna 8, the transmitter 27 is operated to emit a carrier in the 1.2 GHz band concurrently with the amplitude peak of the received signal.

The unit 5 is designed to transmit telemetric format information via a suitable modulator.

The function of the threshold detector 22 is to define a minimum signal level above which the transmitter 27 should be operated. Concurrently therewith, the peak of the detected signal is identified by the amplifier 23 and its associated comparator to also identify the transmission frequency of the received signal.

By having the unit 5 fitted under the body frame 6 of the vehicle 2, its vertical axis can be arranged to lie substantially normal to the axis of the vehicle wheels. Thus, the RF transmission between the unit 5 and the antenna 8 is favored.

Figure 4:
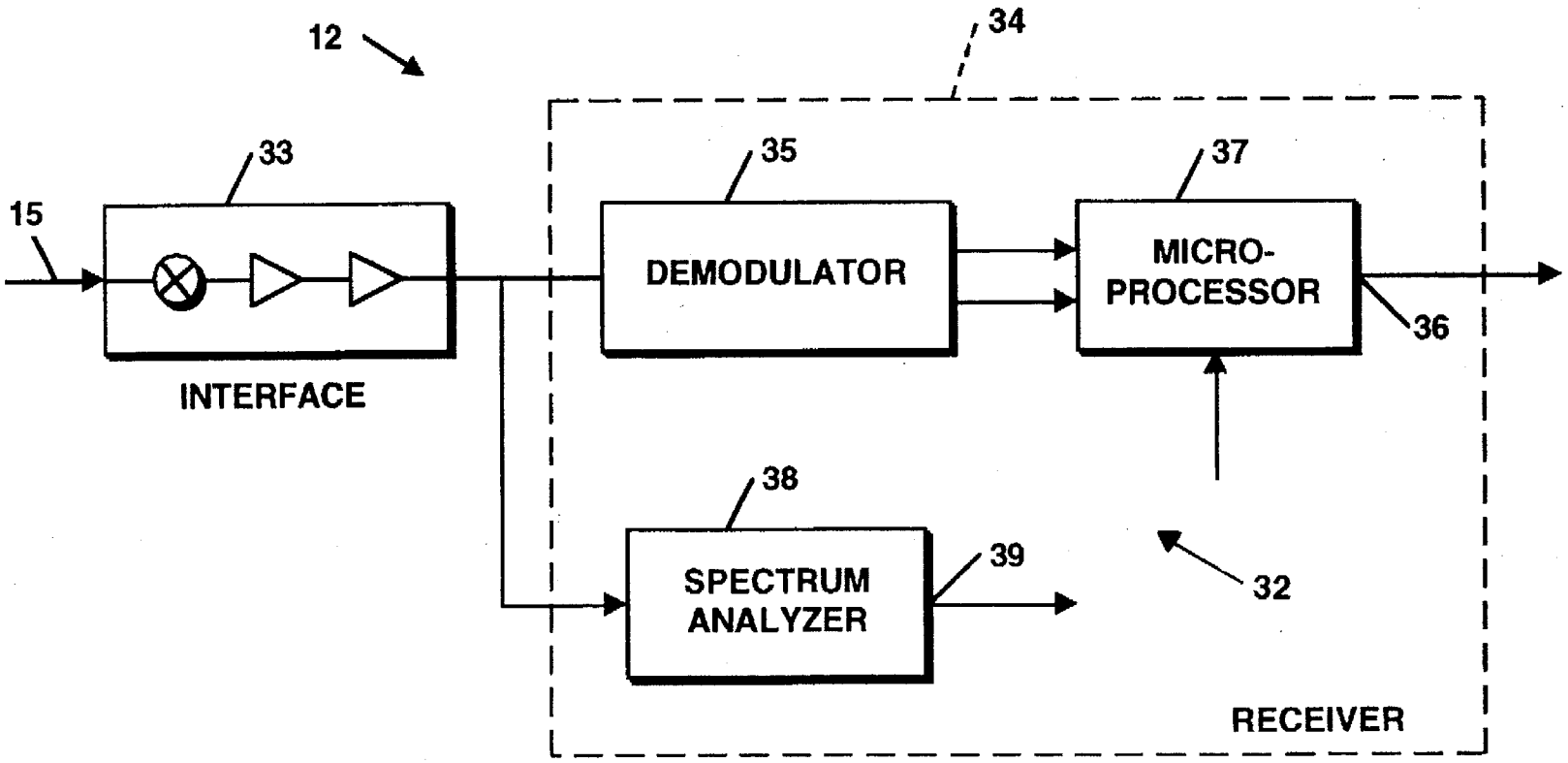
FIG. 4 is a diagramatic representation of a data processing unit associated with the apparatus in FIG. 1.

With reference in particular to the example shown in FIG. 4, the structure and operation of the central unit 12 running to the various detecting stations 10 will be now described.

The input side of the unit 12 receives one end of the coaxial wide band cable 15, and through a frequency conversion followed by amplification at an intermediate frequency by an interface 33, makes an electric signal IF available which can be analyzed by a module 32.

The modules 32 are structurally identical with one another, and the unit 12 is formed by two sets of fifty such modules each: each module being paired with one vehicle in the race.

Each module 32 comprises a receiver 34 tuned to a frequency which corresponds to that of a given vehicle 2. Said receiver 34 comprises a demodulator 35 having an output connected to a microprocessor 37 of the integrated type which is operated on the basis of a timing pulse CK.

A circuit portion 38 is also provided for analyzing the spectrum of the signal IF and allowing, on an output 39, the identification and demodulation of any telemetric transmissions of information directed to an external unit.

The coupling between the demodulator 35 and the microprocessor 37 provides for the former of these components to supply on respective outputs a digital signal indicating which of the detecting stations 10 is transmitting over the coaxial cable 15, as well as which signal has been picked up on a vehicle moving past that station.

The microprocessor will then supply, on an output 36, the above information in the RS232 serial format. That is, each module 32 will output a series of digital information, preferably in the ASCII code, relating to an identification code of the vehicle, a code identifying the detecting station 10, and the acknowledgment of that said vehicle has run past the station at a given time.

This information is used by an electronic processor, not shown because conventional, which is supplied the signals output by all of the various modules 32 to calculate the partial and overall times.

The central unit 12 is able as such to compute the partial and overall travel times around the course of at least a hundred vehicles competing with one another.

The measuring accuracy is on the order of one thousandth of a second for vehicles which can attain a top speed of 400 kilometers per hour.

The apparatus of this invention allows each vehicle running around a racetrack to be identified in real time, while also recording its partial and overall run times. In addition, it allows of the transmission of parameters relating to engine, electric, or aerodynamic performance as issued by monitoring units, sensors or transducers installed on the vehicle.

A major advantage comes from the circuit being split through a plurality of measuring points, which enables the racing record of each vehicle to be substantially re-constructed.

A further advantage is the ability to have a racetrack equipped with the apparatus of this invention on a permanent basis, thus avoiding the costly installation and adjustment operations entailed by conventional systems in current use.

What is claimed is:

1. A high-efficiency apparatus (1) for real time measuring parameters and operational times of vehicles (2) running around a racetrack, said apparatus comprising:

a plurality of detecting stations (10) arranged at selected locations along said racetrack and being set up to both receive and transmit radio frequency (RF) signals both to and from a transceiver unit (5) mounted on each said vehicle (2), said transceiver unit operative to both receive and transmit information both to and from each said station (10), said transmitting from said transceiver unit being in response to said transmitting from said detecting station, said station being provided with electronic radio frequency-converter means (16,20) for transmitting and modulating the received signals over a wide band coaxial cable (15);

said apparatus further comprising;

said wide band coaxial cable (15) forming a loop connection structure whereby said stations are interconnected with a central processing unit (12); and, said apparatus further comprising;

each said station (10) comprises a transceiver antenna (8), an interface (11) associated with the antenna, a high frequency amplifier (14) connected downstream from the interface, a signal mixer (16) having one input connected to the amplifier (14) output and a second input to receive a signal generated by an oscillator (17), and a modulator (20) connected in said coaxial cable (15) and driven by the output from the mixer (16).

2. An apparatus according to claim 1, characterized in that each said station (10) includes a different one of a plurality of antenna (8) laid across the racetrack.

3. An apparatus according to claim 2, characterized in that each different one of said plurality of antenna is buried under the racetrack surface.

4. An apparatus according to claim 3, characterized in that each antenna (8) comprises a section of a cable conductor (9) bent essentially into a U-shape and having the opposite ends of said cable conductor run to a drive/receive interface (11).

5. An apparatus according to claim 1, characterized in that each said station (10) is associated with a different one of a plurality of low-frequency oscillator (7) inputs connected to said interface (11) associated with said antenna (8) and whence interface drive pulses are drawn for RF transmission at least two discrete frequencies.

6. An apparatus according to claim 5, characterized in that said discrete frequencies are 153.6 kHz and 143.6 kHz.

7. An apparatus according to claim 1, characterized in that the signals received and transmitted from/to said transceiver unit are low and high frequency signals, respectively.

8. An apparatus according to claim 1, characterized in that said transceiver unit (5) comprises a low frequency receiver (30) and a high frequency transmitter (27).

9. An apparatus according to claim 8, characterized in that said transmitter (27) is linked operatively to the detection of a signal by said receiver (30).

10. An apparatus according to claim 1, characterized in that said central processing unit (12) comprises a plurality of structurally independent modules (32) corresponding in number to that of the vehicles (2) taking part in the racing event, each module being provided with a different one of a plurality of receivers (34) each of said ones of receivers tuned to a different one of a plurality of frequencies corresponding to that transmitted by one of a plurality of transceiver units (5) of one of a plurality of vehicles in the race and with one of a plurality of microprocessors (37) connected thereto to encode parameters identifying the specific one of said vehicles, the detecting station (10), and the time when said specific one of said vehicles has moved past said station.

11. An apparatus according to claim 8, characterized in that said transmitter (27) is linked operatively to the detection of a signal by said receiver (30).

12. An apparatus according to claim 8 characterized in that said receiver (30) comprises a first winding tuned to a frequency of 153.6 kHz and a second winding tuned to a frequency of 143.6 kHz.

13. An apparatus according to claim 11, characterized in that connected downstream from the receiver (30) is an amplifier (21) whose output is connected to a control circuit portion (40) comprising, on the one side, a threshold detector (22), and in parallel the other side, the series of a differential amplifier (23) and a comparator (24).

14. An apparatus according to claim 13, characterized in that connected downstream from said control portion (40) via a logic gate (26) is the high frequency transmitter (27).

15. An apparatus according to claim 11, wherein said transmitter (27) emits RF signals in the 1.2 GHz band.

* * * * *